US008695416B2

(12) United States Patent
Fortin

(10) Patent No.: US 8,695,416 B2
(45) Date of Patent: Apr. 15, 2014

(54) METHOD OF EXAMINING A COIN FOR DETERMINING ITS VALIDITY AND DENOMINATION

(75) Inventor: Eric S. Fortin, O'Fallon, IL (US)

(73) Assignee: Coin Acceptors, Inc., St. Louis, MO (US)

( * ) Notice: Subject to any disclaimer, the term of this patent is extended or adjusted under 35 U.S.C. 154(b) by 582 days.

(21) Appl. No.: 12/446,269

(22) PCT Filed: Oct. 22, 2007

(86) PCT No.: PCT/US2007/022477

§ 371 (c)(1), (2), (4) Date: Oct. 25, 2010

(87) PCT Pub. No.: WO2008/051537

PCT Pub. Date: May 2, 2008

(65) Prior Publication Data

US 2011/0023596 A1 Feb. 3, 2011

Related U.S. Application Data

(60) Provisional application No. 60/862,351, filed on Oct. 20, 2006.

(51) Int. Cl.
*G07D 5/00* (2006.01)

(52) U.S. Cl.
USPC ..... 73/163; 453/3

(58) Field of Classification Search
USPC ..... 73/163
See application file for complete search history.

(56) References Cited

U.S. PATENT DOCUMENTS

| | | | | |
|---|---|---|---|---|
| 5,797,475 | A * | 8/1998 | Bointon et al. | 194/317 |
| 6,640,955 | B1 * | 11/2003 | Furuya | 194/317 |
| 6,886,680 | B2 * | 5/2005 | King | 194/207 |

* cited by examiner

*Primary Examiner* — Lisa Caputo
*Assistant Examiner* — Roger Hernandez-Prewitt
(74) *Attorney, Agent, or Firm* — Polster Lieder Woodruff & Lucchesi, L.C.

(57) ABSTRACT

A method of examining a coin for determining the validity of its denomination, comprises the steps of moving a coin through a passageway, sensing said moving coin in said passageway with one or more sensors to interact with said moving coin and provide at least two values indicative of the said coin, calculating two or more coin features by using said at least two values, determining that said coin features values lie between predetermined minimum and maximum stored values, applying predetermined coefficients of weighted-error to each of said coin features, calculating weighted-error correlation coefficients using two or more of the said coin feature values, and determining validity when the said calculated weighted-error correlation coefficient is above predetermined minimum stored values, or when said coefficient is the maximum of all calculated coefficients.

7 Claims, 6 Drawing Sheets

Fig. 3 - Prior Art
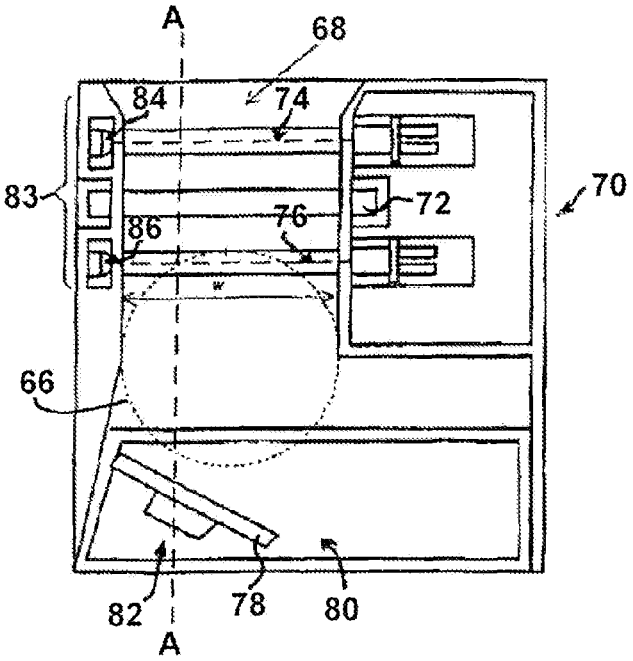
Fig. 4 - Prior Art
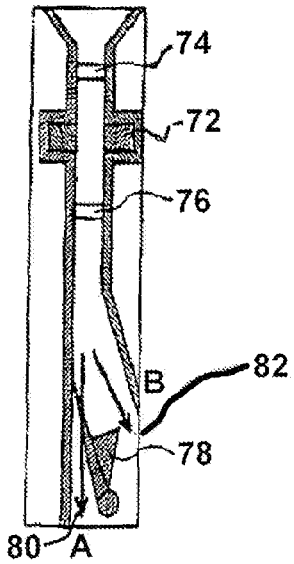
Fig. 5 - Prior Art
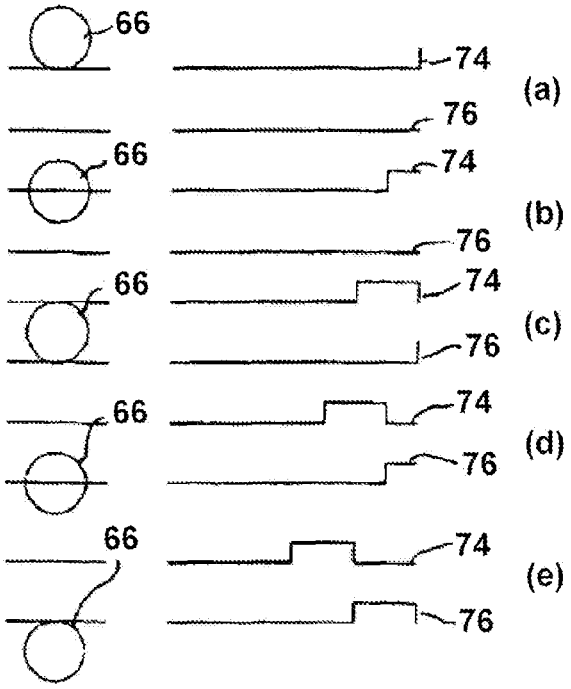

Fig. 6
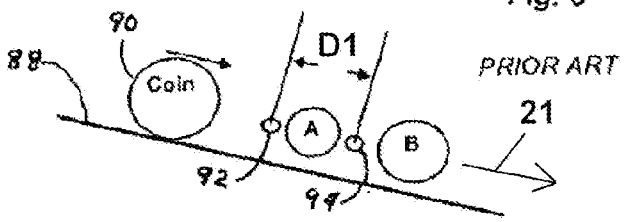
PRIOR ART
Fig. 7
PRIOR ART
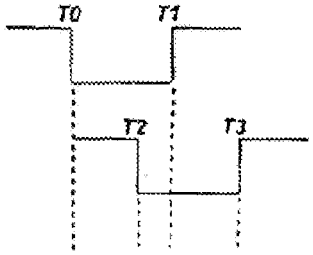
Fig. 11
Features:
1 Size
2 Symmetry [ T0 - T1 / T0 - T2 ] = OS
3 Coil Magnetic Sizing ( T0 - T1 / T0 - T2 ) / TA = MS
4 Coil A Fequency
5 Coil A Phase
6 Coil A Tau 1
7 Coil A Tau 2
8 Coil B Frequency
9 Coil B Phase
10 Coil B Tau 1
11 Coil B Tau 2
12 Ratio Coil A Tau 1 to 2
13 Ratio Coil B Tau 1 to 2
14 Coil A Amplitude 1
15 Coil B Amplitude 1
16 Ratio Amplitude 1 of Coil A to Coil B
17 Coil A Phase / Coil A Fequency
18 Coil B Phase / Coil B Fequency
Fig. 8
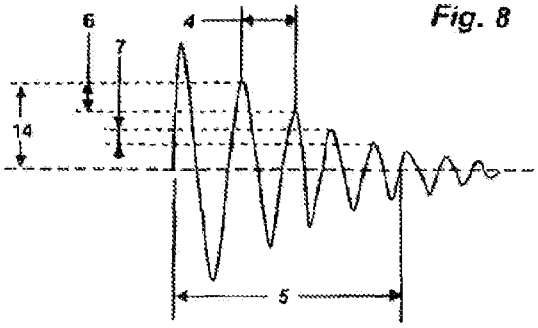
Fig. 10
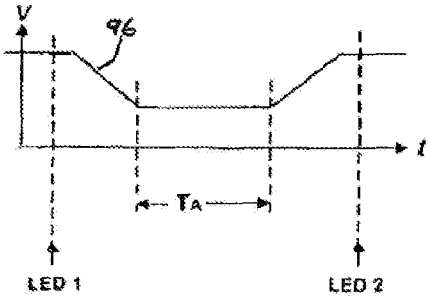
Fig. 9
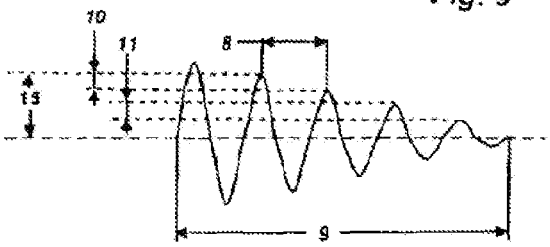

METHOD OF EXAMINING A COIN FOR DETERMINING ITS VALIDITY AND DENOMINATION

The present invention claims priority to U.S. Provisional Patent Application No. 60/862,351, filed Oct. 20, 2006. The contents of said application are incorporated herein by reference.

BACKGROUND OF THE INVENTION

Devices for recognizing, identifying and validating objects such as coins are widely used in coin acceptor and coin rejecter mechanisms and many such devices are in existence and used on a regular basis. Such devices sense or feel the coin or other object as it moves past a sensing station and use this information in a device such as a microprocessor or the like to make a determination as to the genuineness, identity and validity of each coin. Such devices are very successful in accomplishing this. However, one of the problems encountered by such devices is the presence of variations in the same type of coin from batch to batch and over time and other variables including wear and dirt. These will cause changes, albeit small changes in some cases and from one coin type to another including in the U.S. and foreign coin markets. Such changes or variations can make it difficult if not impossible to distinguish between genuine and counterfeit coins or slugs where the similarities are relatively substantial compared to the differences.

The present invention takes a new direction in coin recognition, identification and validation by making use of a weighted error correlation coefficient algorithm. This technology has not been used heretofore in devices for sensing, identifying, recognizing and validating coins such as the coins fed into a vending or like machine. The use of weighted error correlation coefficient algorithm has the advantage over known devices by producing superior results when considering ease of implementation as opposed to more complex pattern recognition methods as it is a relatively transparent and straightforward algorithm, restriction to integer math due to being ultimately coded for a cost-effective embedded target, and ability to recognize data trends while still giving separation due to gross errors. The present invention therefore represents a technology in a coin sensing environment which has not been used in the past.

SUMMARY OF THE INVENTION

The method of the present invention utilizes an inclined rail to roll coins and other similar objects, past one or more sensors to sense two or more characteristics of the coin resulting in measurements of parameter of the coin. In accordance with the present invention, a number of features are developed using the measurements. Each resulting feature is identified as to where it fits within its predetermined limits. Each feature is factored with a pre-assigned degree of significance and all are used in a validation algorithm to determine acceptability.

With the present system it is recognized that each different coin denomination will have its own pattern and the same system can be used to recognize, identify and validate, or invalidate, coins of more than one denomination including coins of different denominations from the U.S. and foreign coinage systems.

The novelty of the present invention relates in large part to the signal processing and the method that is used. The signal processing involves extracting features from signals generated during passage of a coin and interpreting these signals in a feature manipulation process. This increases the performance sensitivity without adding new or more complicated sensors.

In a preferred embodiment of the present device utilizes two pairs of coils connected with capacitors to result in two tank circuits with two frequencies, and uses two optical sensors. Furthermore, each coin when magnetically and optically sensed will produce distinctive features that determine their denomination value and metallic authenticity.

The present device includes the sensors, the signal conditioning circuits including the means for controlling the sensors, data acquisition means, feature determination and algorithm implementation. The physical characteristics of the sensors may be of known construction such as shown in Wang U.S. Pat. No. 5,485,908.

BRIEF DESCRIPTION OF THE DRAWINGS

Referring now to the drawings in which like reference numbers represent corresponding parts throughout.

FIG. 3 is a drawing of the prior art showing a coin acceptor with a passageway with sensors for a vertically descending coin;

FIG. 4 is a drawing of the side view of FIG. 3;

FIG. 5 is a drawing of the resulting outputs sensed by the passage of a coin falling through the prior art acceptor of FIGS. 3 and 4;

FIG. 6 is a drawing of the prior art showing an inclined passageway for a rolling coin, using two coils and two optic sensors;

FIG. 7 is a drawing showing the resulting optical signals of a passing coin in the prior art shown in FIG. 6;

FIG. 8 is a drawing of the signal provided from the coil A of FIG. 6;

FIG. 9 is a drawing of the signal provided from the coil B of FIG. 6;

FIG. 10 is a drawing showing the magnetic sizing profile from coils A of FIG. 6 when a coin rolls across the two optic paths;

FIG. 11 is a listing of features numbered 1 through 18 which refer to the like designations in FIGS. 8 and 9;

DESCRIPTION OF THE PRIOR ART

Figure 1:
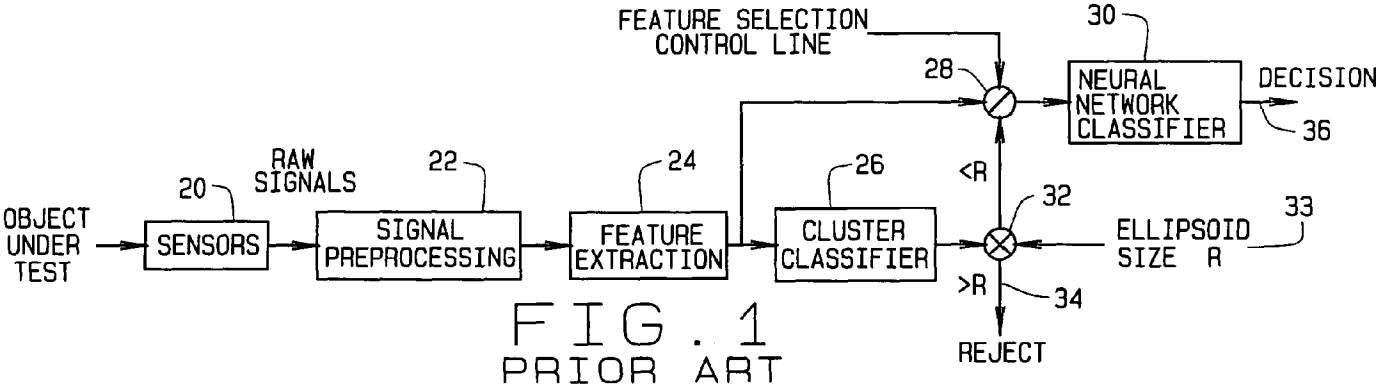
FIG. 1 PRIOR ART
FIG. 1 shows a schematic block diagram of a prior art coin validation system using a neural network classifier.

Referring to the drawings more particularly by reference numbers, number 20 in FIG. 1 refers to the sensors used in the prior art device. The sensors are mounted adjacent to a coin track 21 of FIG. 6 along which the moving coins or other objects are sensed. The construction of the sensors 20 is important to the invention and is described more in detail in Wang U.S. Pat. No. 5,485,908. The outputs of the sensors 20 typically include four signals of different frequencies which are fed to a signal preprocessing circuit 22, the outputs of which are fed to a feature extraction algorithm 24 constructed to respond to particular features of the signals produced by the sensors. The feature extraction algorithm 24 produces outputs that are fed to a cluster classifier device 26 and also to a switch 28 which has its opposite side connected to a neural network classifier circuit 30. The neural network classifier circuit 30 includes means for producing decision output 36 based upon the inputs it receives.

The cluster classifier device 26 has an output on which signals are fed to a comparator circuit 32 which receives other inputs from an ellipsoid shaped raster or area 33. The outputs of the comparator circuit 32 are fed to the switch 28 for applying to the neural network classifier 30. The comparator 23 also produces outputs on lead 34 which indicate the presence of a rejected coin. This occurs when the comparator circuit 32 generates a comparison of a particular type. The decisions are produced on output 36 of the neural network classifier 30.

The signals collected by the sensors are processed by the signal preprocessing. Extraction of the most dominate and salient information about the coin occurs in the feature extraction circuit 24. A feature vector (FV) is formed by combining all of the preprocessed information, and this feature vector (FV) is then fed to the hyper ellipsoidal classifier circuit 26 which classifies the object or coin according to its denomination. If the object or coin is not classifiable by its denomination because it is a counterfeit coin or slug, the classifier circuit will produce an output from a comparator 32 that is used to reject the coin. This is done by producing a signal on lead 34. The classification of the coin takes place in the comparison means 32 which compares the output of the cluster classifier 26 with an ellipsoid shaped output received on another input to the comparator 33.

After all of the neural networks have been trained, and such training is known the subject coin validation system is ready for classification. The signals with their distinctive features are then collected from the unknown object or coin and are formed into the feature vector (FY). The feature vector is first verified to see if it falls within an ellipse as defined by the mathematics of the system. The object or coin is rejected as being counterfeit if its feature vector is found not to fall in any ellipse. Otherwise it is assumed to be a valid coin. If not rejected the object or coin is considered as a candidate and the same feature vector is fed to the neural network and the output levels from the network are compared against each other. The object or coin is again subject to being rejected as counterfeit if the output value of the first neuron level is greater than that of the second neuron level. Otherwise it will be accepted as a valid coin belonging in a predetermined denomination or range of denominations.

Figure 2:
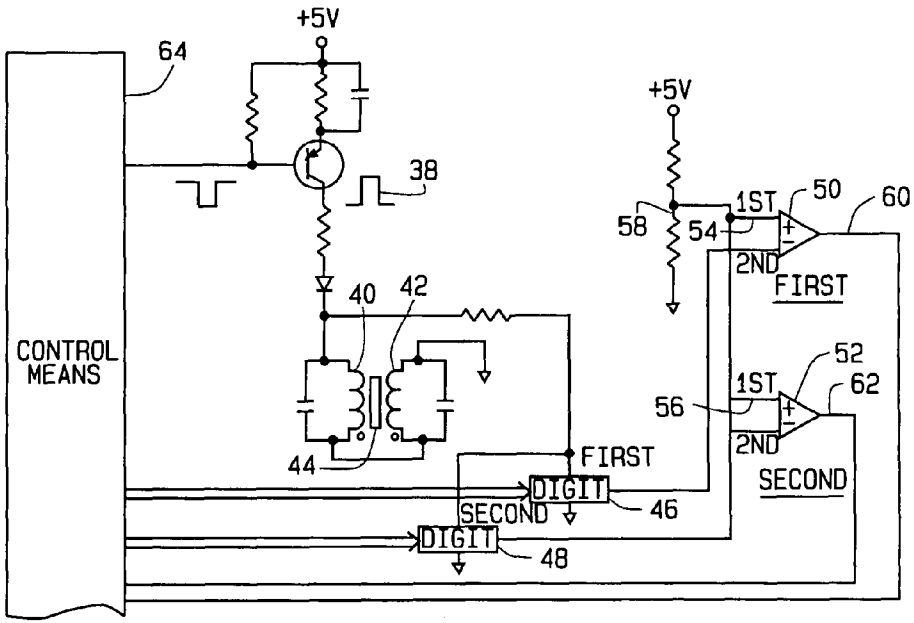
FIG. 2 PRIOR ART
FIG. 2 is a schematic circuit of the prior art showing a means to determine when a coin sensor output falls within two predetermined levels.

Refer now to FIG. 2 which shows the apparatus of Levasseur U.S. Pat. No. 5,293,979 which determines an acceptable coin by providing a pulse 38 to coils 40 and 42 which creates a damped waveform that is influenced by the coin 44. Two proportions of this waveform are digitally set by two digital potentiometers 46 and 48 to establish a range of acceptable variation of the damped waveform amplitude. One digital potentiometer 46 is set for the lowest permissible signal amplitude and the other potentiometer 48 sets the highest permissible signal amplitude for presentation to the comparators 50 and 52 respectively, having their reference inputs 54 and 56 connected to the reference voltage 58. The comparators 50 and 52 outputs 60 and 62 respectively are monitored by the control means 64 to determine that the wave form portion being monitored stays within the predetermined upper and lower limits for signifying an acceptable coin.

Refer now to FIGS. 3 and 4 which show the apparatus of Wood U.S. Pat. No. 6,053,300 for accepting a coin 66 that drops down vertically from the upper portion 68 the acceptor 70 passing by its coils 72 and optical beams 74 and 76. An accept gate 78 is arranged for diverting coins along either of two routes 80 or 82. The accept gate 78 normally blocks route 82 but is opened if the signals from the sensor stations 83 indicate that a valid coin has been inserted into the acceptor 70. Two elongate sense coils 72 are located between the upstream and the downstream optical sensor stations. The photo sensors 84 and 86 are connected to interface circuitry which produces digital signals in response to interruptions of the upstream and downstream beams as a coin falls along the passageway past the said sensor photo sensors 84 and 86. As explained in U.S. Pat. No. 6,053,300, coin signals are fed to a microprocessor and the inductive coupling between the coils 72 and a passing coin 66 gives rise to apparent impedance changes for the coils 72 which are dependent on the type of coin under test. If, as result of the validation processes performed by the microprocessor, the coin is determined to be a true coin, a signal is applied to a gate driver circuit in order to operate the accept gate 78 so as to allow the coin to follow the accept path 82, and provides an output indicating the denomination of the coin. FIG. 5 shows the signals from the photo sensors 84 and 86 as the coin 66 interrupts the optical beams 74 and 76 of FIG. 3. at positions (a) through (e). The known distance between the beams, and the time of the coin's interruption between each, together with the duration at each beam, is used to determine the diameter of the coin.

DESCRIPTION OF THE PREFERRED EMBODIMENTS

Turn now to the FIG. 6 drawing showing an inclined passageway 88 for a rolling coin 90, using two coils A and B and two optic beams 92 and 94 from two (not shown) Light Emitting Diodes (LED 1 & 2). As the coin 90 rolls from left to light it interrupts the two optic beams 92 and 94, causing the resulting outputs from the optical sensors (not shown) to indicate the coin's 90 presence, as is shown in FIG. 7 whereby is shown T0 when the coin 90 first breaks the beam 92 and T3 when the coin 90 finishes breaking the beam 94. T1 and T2 depict the duration of interruption for the beam 92, and beam 94, respectively.

FIGS. 8 and 9 show the damped waves produced at the coils A and B, respectively, with one half of each of coil A and B on each side of the coin path of FIG. 6 and each half being connected in series opposing relationship to each other and having a capacitor (not shown) across them to form a tank circuit which produces a decaying (damped) waveform when a pulse thereto is removed. The designations 4 through 14 designate the locations for the various listed features (likewise designated) referenced in FIG. 11.

FIG. 10 shows the relative amplitude 96 of feature 14 in FIG. 11 as the coin 90 of FIG. 6 passes the LED 1 and LED 2 and covers coil A causing the feature 14 to decrease to an amplitude that is shown as TA. The coil magnetic sizing is created by the many times feature 14 is developed as the coin rolls past coil A and is compared to the chord size derived from the events plotted in FIG. 7.

FIG. 11 gives reference to some of the various features used in the preferred embodiment concerning amplitudes, frequency, phase, and Tau measurements at various points of the damped waveforms of both coil A and B independently, and in various combinations.

Figure 12:
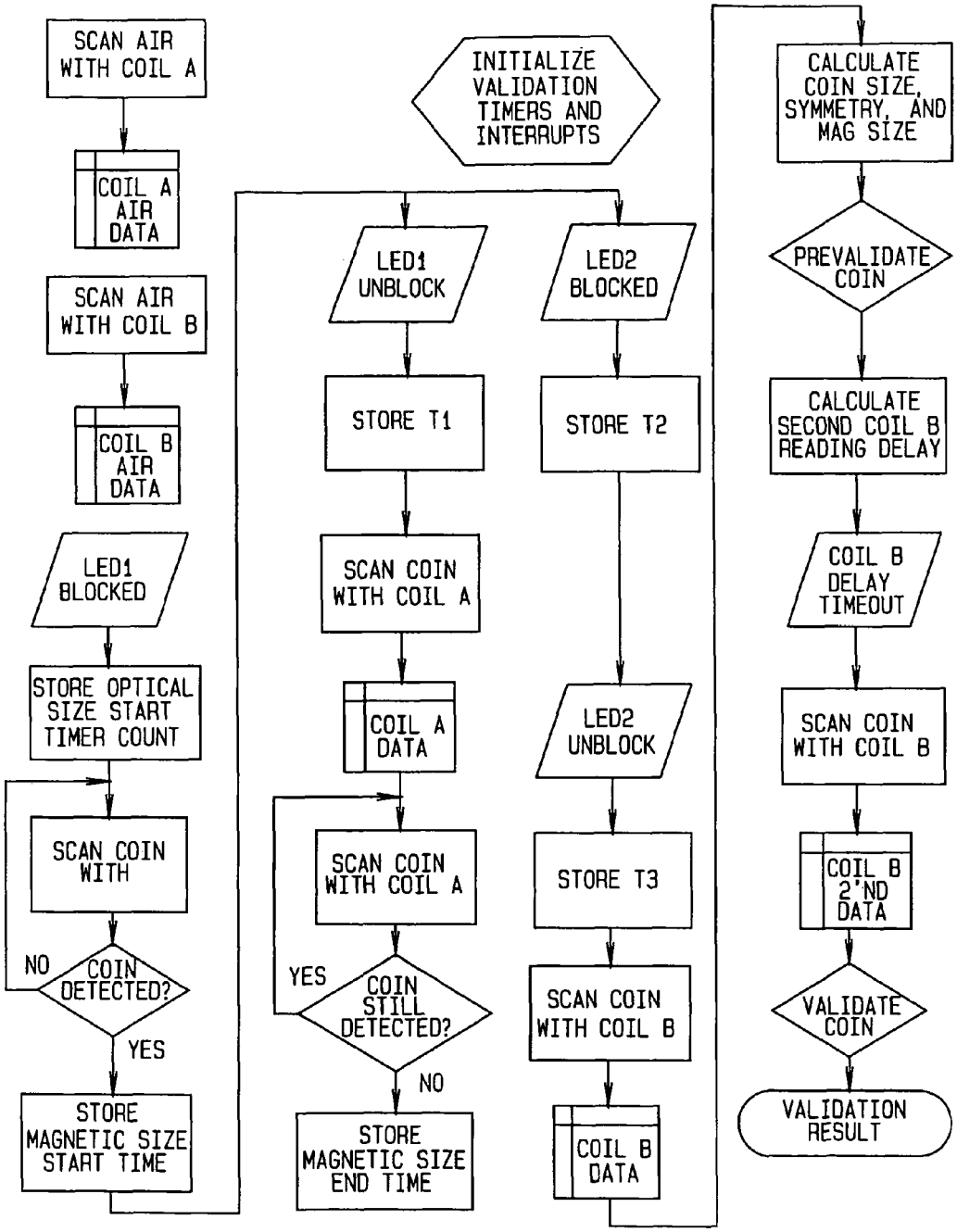
FIG. 12 is a flow chart showing the functions for extracting features from the sensors in FIGS. 6 through 10.

FIG. 12 is a flow chart showing related timing of events as various measurements are performed as a coin rolls down the track with sensors as shown in FIG. 6.

Figure 13:
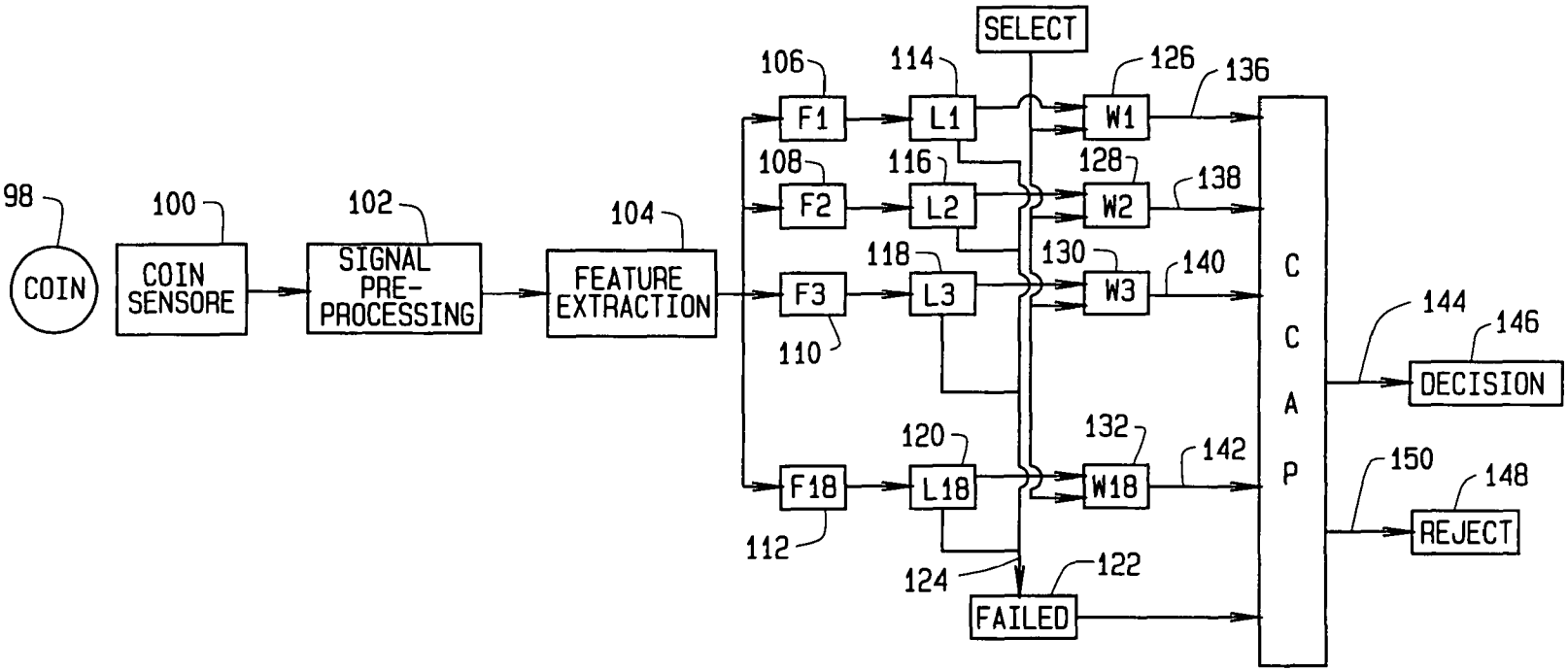
FIG. 13 is a flow chart showing additional functions for processing the features for coin validation of the present invention.

The flow chart of FIG. 13 shows the relationship and flow of operations for processing the features for coin validation of the present invention. The coin 98 is sensed by the COIN SENSORS block 100 with the SIGNAL PRE-PROCESSING block 102 providing the various measurements for the FEATURE EXTRACTION block 104. The feature values extracted for F1 106, through F18 112 are directed to L1 114 through L18 120, respectively for determination of each extracted feature value to fit within predetermined upper and lower limits. If any one does not fall within said limits then the corresponding failure signals the Failed block 122 via input line 124. If all are within said limits, the accepted values are applied predetermined weights at W1 block 126 through W18 block 132. The CCAP block 134 (Correlation Coefficient Algorithm Processor) controls the functions of all the blocks 100 through 148 and in particular takes the error weighted feature values at lines 136 through 142 and applies the weighted error correlation coefficient algorithm to determine the output at line 114 for the Decision block 146. Any determined failure to pass acceptability is provided to the reject block 148 by line 150.

Figure 14:
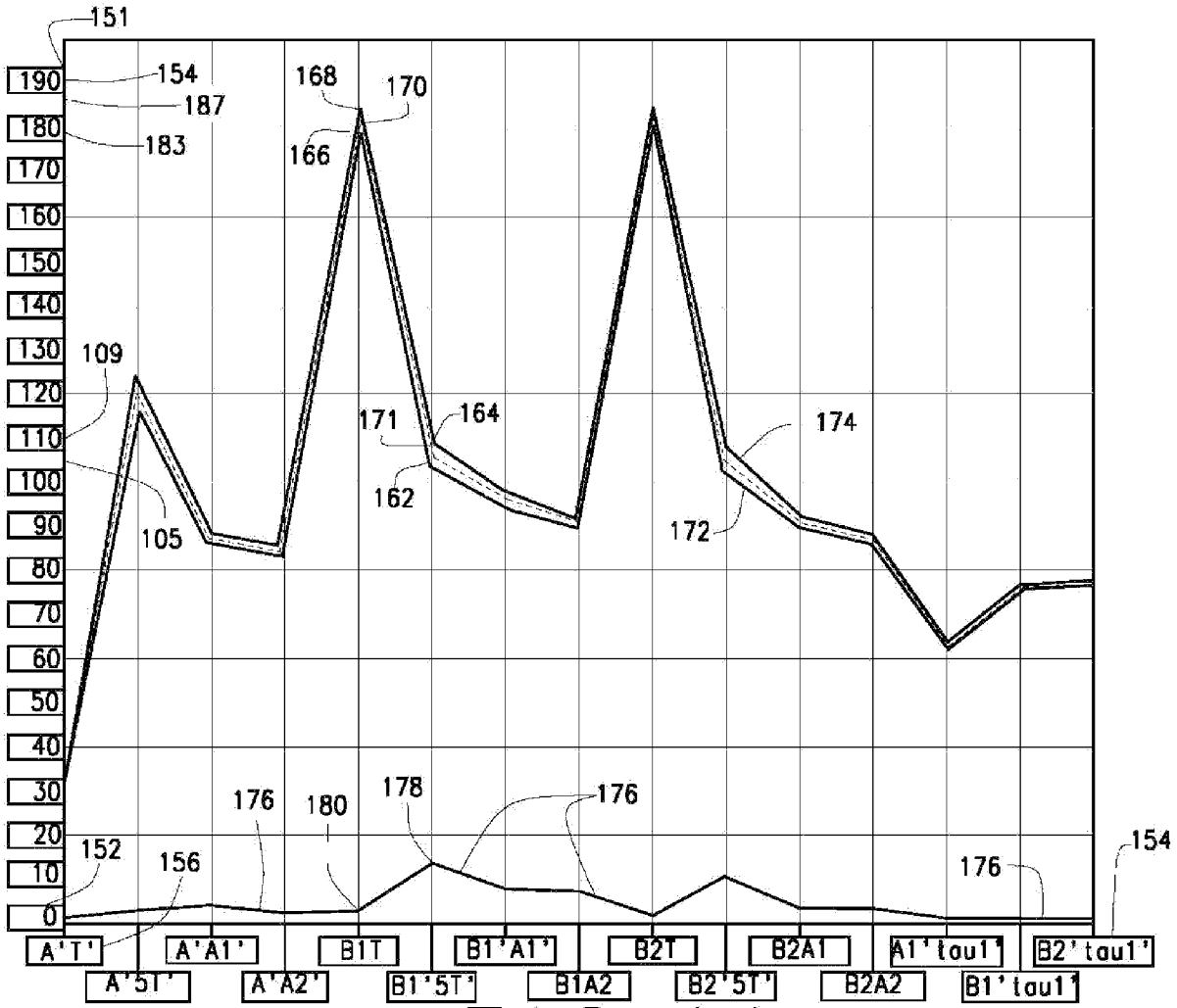
FIG. 14 is a drawing of 15 different magnetic features plotted showing maximum and minimum values, and a nominal (or statistical mean) plot for each feature used in the weighted-error correlation coefficient calculation.

FIG. 14 depicts 15 different magnetic features plotted showing the maximum and minimum values for a particular denomination coin, and a nominal plot for each feature. The vertical scale 151 from "0" 152 up to "190" 154 representative the range for the feature values of A"T" 156 through B2"tau1" 158 located along the horizontal scale. For example, the feature of B1"5T" 160 show its minimum level162 point at about 105, and its maximum level164 point at about 109 on the vertical scale 151. The feature B1T shows its minimum level 166 point at about 183 and the maximum level 168 at about 187 on the vertical scale 151. The nominal (or mean value) is determined by testing a large representative number of the particular coin to validated, and that nominal value level is shown at points 171 and 170 for the two features illustrated thus far. Those points are shown interconnected with a dashed line for easy reference. The minimum lines 172 and the maximum lines 174 interconnect the lower and upper limit points respectively of each of the said two illustrated features thus far. Those points are shown interconnected with a solid line for easy referencing.

The amount of difference between the minimum and maximum value and the nominal value for each feature can vary greatly and particularly between other coin types being validated. A coin being considered for validation must produce a value within the minimum and maximum limits on all tested features being tested. At this point, it should be understood that the weighted-error coefficient values for each feature will increment or decrement a change in the level of the nominal feature value in respect to its upper and lower limits for that coin. The weighted-error coefficient value line 176 indicates the relative weight assigned as shown at each feature. For the said two features illustrated thus far in FIG. 14, it would be at the relative levels point 178 and point 180. Whereas the weighted-error coefficient value line 176 indicates that relative weights assigned are all in a positive direction (the preferred embodiment), any can be in a negative direction. The weights are selected based on statistical analysis of pre-collected or historical data, which may include feature extraction algorithms and neural networks. The calculated coefficient is normally in the range of −1 to 1, just like Pearson's correlation coefficient, but in a preferred embodiment, the intermediate calculated values are scaled using microcontroller bit shifts such that the result lies in the range of −1024 to 1024, with the typical correlation coefficient passing score for a valid denomination being above 850.

The other features shown in FIG. 14 relate in part, to features listed in FIG. 11, and some of which will be discussed in the following description. Other combinations are anticipated as well.

To perform coin validation, two key components are required: sensors that capture information about the coin, and a numerical solution for classifying coins based on that information. With new coin validation products, the goal is to improve on preexisting methodologies, usually by incorporating advancements from among the following:

1) Greater sensor data acquisition accuracy and resolution.
2) Introduction of new features.
3) Elimination, replacement, or improvement of substandard functionality
4) Utilization of better sensors that exhibit reduced manufacturing variance, increased sensitivity, etc.
5) Utilization of better numerical classification methods.

The present invention will show 18 validation features—3 sizing features, and 15 magnetic features. The three sizing features all involve math using multiple sensor readings, and all 15 of the magnetic features are obtained directly from sensor readings. Three of the magnetic features are produced by user-configurable algorithms, whereby an equation is represented by placeholders that represent the features to use as variables, as well as mathematical operators. These features are hereafter referred to as "virtual features".

The magnetic features consist of 5 readings from 3 separate scans of the coin with the magnetic sensors, called coil A scan, coil B1 (first B) scan, and coil B2 (second B) scan. The first is captured using coil A (120 KHz), and the second and third of which are captured using coil B (16 KHz). The 5 readings are the coil period (time between the first and second successive peaks of the decaying sinusoid), phase (time between the first and nth sampled peaks, where n>2), 2 successive peak amplitudes, and difference between the two peaks (tau), respectively. During coil data collection, 10 peak amplitudes of each scan are obtained, for 30 peaks total. On coil A, due to its high frequency relative to the digitizing speed of the analog-to-digital (ATD) hardware, the peaks sampled are actually just the odd peaks starting with the third (peaks 3, 5, 7 . . . 21). The coil B peaks are sampled are every peak starting with the second (peaks 2 through 11).

Algorithm Details on "Size":

High (2 bytes) and Low (2 bytes) SIZE boundary values for sixteen (16) coin types (0-F) are stored in nonvolatile memory (e.g., EEPROM, flash, etc.).

Coin "sizing" is triggered by an interruption of the optics at LED1. Final coin size is calculated assuming a constant coin acceleration, a fixed LED distance (LED2−LED1) and times T0, T1, T2, and T3 where:

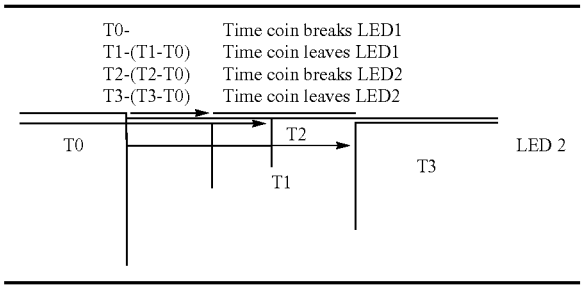

The SIZE is calculated using the following formula:

$$\text{SIZE} = \frac{\text{LED_DIST} * (T1 * T2) + \frac{(T3 * T3) - (T1 * T3) - (T2 * T2)}{T2}}{\frac{(T1 * T2) + (T3 * T3) - (T1 * T1) - (T2 * T3)}{T1}}$$

Symmetry

This is the ratio of the optic blocking/unblocking times, giving not only an indication of the diameter of the coin, but exhibiting more distribution for coins that are sided/asymmetric (more so than the Optical size calculation). It is calculated using the formula:

$$\text{symmetry} = \frac{t1 * (t3 - t2) * \text{SCALE } CONST}{t2 * (t3 - t1)}$$

where:

"symmetry" is the calculated coin symmetry t1=total LED1 blocking time t2=time until LED2 blocking t3=time until LED2 unblocking SCALE_CONST=scaling factor for integer math purposes (otherwise a fractional result is obtained)

Notes:

Since this feature is purely ratiometric, it is virtually unaffected by temperature variation, and is a dimensionless value. This calculation assumes constant acceleration.

Magnetic Size

This feature is a ratio of the coil A magnetic detection time versus the total optic blocking time. The magnetic detection time is the time the coil A peak amplitude first varies by 100 or more millivolts from air to when it is back within 100 millivolts of the air reading (this is configurable). It is calculated using the formula:

$$\text{mag_ratio} = \frac{\text{mag_time_end} - \text{mag_time_start}}{t3/4}$$

where:

"mag_ratio" is the calculated magnetic size mag_time_start=time the coin is first magnetically detected mag_time_end=time the coin is last magnetically detected t3=time until LED2 unblocking (scaled for integer math purposes)

Notes: Since this feature is purely ratiometric, it is virtually unaffected by temperature variation, and is thus dimensionless.

This feature is dependent on the thickness and permeability of the metallic material being measured, as well as proximity of the coil to the coin.

Coil A, B1, and B2 Period

This feature is the time between two successive phase-detect crossings by the coil validation hardware. The phase-detect (aka zero-cross/DC cross comparator) circuitry provides a signal to an HC12 (a microcontroller manufactured by Freescale Semiconductor) input capture timer, which is used to not only determine the frequency the tank is oscillating at, but synchronizes ATD peak sampling. A single period is used as a feature due to the tight distribution it exhibits for like coins.

Notes: This feature is in units of HC12 timer counts, which is operating at a bus frequency of 24 MHz. Thus each period count corresponds approximately to 41.6 nanoseconds.

This feature is air-reading compensated for temperature normalization purposes.

Coil A, B1, and B2 Phase

This feature is the time between the phase-detect crossing at the first peak sample acquisition and the last sample acquisition. This feature is used as it gives a very sensitive indication of the magnetic permeability of the coin (which corresponds to the impedance of the tank, or how the coin disturbs the mutual inductance of the opposing coils). It is has the broadest distribution of the magnetic features for like coins, but is often useful in providing more separation between dissimilar coins.

Notes: This feature is in units of HC12 timer counts, which is operating at a bus frequency of 24 MHz. Thus each period count corresponds approximately to 41.6 nanoseconds.

This feature is air-reading compensated for temperature normalization purposes.

Coil A, B1, and B2 Amplitudes

While up to 10 peak amplitudes are collected for every coin, only 2 are used for validation. These 2 are independently selectable per scan, but currently must be successive, i.e., peaks 1 and 2, or peaks 8 and 9, etc. They should be selected for their ability to aid in distinguishing dissimilar coins during tune development.

Notes:

These features are in units of HC12 ATD counts. As it is a 10-bit ATD, each count corresponds to approximately 5 millivolts.

Two peaks are used because it also embeds some characteristic of the different decay rate of the coil signal for dissimilar coins.

Not all 10 peaks are always obtained, especially for ferromagnetic coins (the fewest ever obtained has been observed to be 2). Typically, only 3 to 5 peaks are obtained for more magnetizable coins.

Coil A, B1, and B2 Tau (User Configurable Features)

These 3 features are placeholders for virtual features. Currently, they are simply the difference between the 2 peaks selected for validation, which gives a characteristic of the decay rate of the signal. This feature has been exhibited to have a much tighter distribution than the peak amplitudes themselves—i.e., when 1 peak is offset for a like coin during a successive scan, the other peak will maintain a virtually constant ratio with the first peak.

After the data is conditioned, it is compared to various nominal feature vectors, some comprising valid coins, and others invalid slugs. Whichever produces the highest passing correlation result while passing its respective minimum correlation score is assumed the pattern match.

The method utilized for performing pattern recognition in this application is a novel weighted-error correlation algorithm. This algorithm was developed as a direct result of researching various pattern recognition methodologies, which were comprised of various statistical data classification algorithms, as well as BMP and SOFM ANNs.

Weighted Error Correlation

The significance of the correlation coefficient is that it is an indicator of how well two data vectors follow the same trend by performing a least sum-of-squares regression line slope comparison via a moment product. In the task of coin validation, the data vectors being correlated are the nominal coin data versus the collected coin data. A coefficient of 1 indicates that the correlated vectors have parallel regression lines. A coefficient of 0 indicates that the vectors are independent, and a coefficient of −1 indicates that the vectors are orthogonal; i.e., their regression lines are perpendicular. The algorithm for calculating the two-dimensional Pearson's Correlation Coefficient is as follows:

$$r = \frac{\sum_{i=1}^{N} X_i Y_i - \frac{1}{N}\sum_{i=1}^{N} X_i \sum_{i=1}^{N} Y_i}{\sqrt{\left(\sum_{i=1}^{N} X_i^2 - \frac{1}{N}\left(\sum_{i=1}^{N} X_i\right)^2\right)\left(\sum_{i=1}^{N} Y_i^2 - \frac{1}{N}\left(\sum_{i=1}^{N} Y_i\right)^2\right)}}$$

Equation 1

Pearson's Correlation Coefficient Algorithm

Where:

r is the correlation coefficient, which ranges from −1 to 1,

N is the number of data points (samples) being correlated,

X and Y are N-dimensional data arrays.

The correlation coefficient has some analytical deficiencies denoted by the following:

The correlation coefficient does not characterize the grouping of the data about the best-fit line, but rather the fraction of the variability that can be attributed to linear dependence. Data that are tightly grouped about a line will nevertheless have zero correlation coefficient if that line has a zero slope. The same degree of scatter about a line with unity slope can give a high correlation coefficient. Thus if the data being correlated consists of small samples with small scatter, it will produce a lower coefficient than pairs of data with similar scatter but greatly disparate values with respect to the other pairs. Thus it is desirable to artificially adjust the samples such that they are clustered about a line that has a non-unity/nonzero slope, if they normally don't.

For small samples, large values of the correlation coefficient can arise purely from statistical fluctuations. Correlation coefficients calculated using small samples must be interpreted carefully to avoid falsely attributing too much significance to them.

These are issues inherent with the correlation coefficient calculation, but due to the nontrivial nature of the data being analyzed in this application, are non-problematic.

A desirable feature of the correlation coefficient is that the trend of the data (that is, their respective ratios) is as important as the data itself. E.g., if two data vectors are separated by a constant offset but follow an identical trend, then the correlation coefficient would still indicate that those vectors are identical. This also holds true for the weighted-error algorithm when utilizing identical weights for all the features.

The equation for a prior weighted correlation coefficient algorithm for the purpose of contrasting with the weighted-error correlation coefficient algorithm is as follows:

$$W_N = \sum_{i=1}^{N} W_i$$

$$\overline{X}_W = \frac{\sum_{i=1}^{N} X_i W_i}{W_N}$$

-continued $$\overline{Y}_W = \frac{\sum_{i=1}^{N} Y_i W_i}{W_N}$$

$$r_w = \frac{\sum_{i=1}^{N} W_i (X_i - \overline{X}_W)(Y_i - \overline{Y}_W)}{\sqrt{\left(\sum_{i=1}^{N} W_i (X_i - \overline{X}_W)^2\right)\left(\sum_{i=1}^{N} W_i (Y_i - \overline{Y}_W)^2\right)}}$$

Equation 2

Prior Weighted Pearson's Correlation Coefficient Algorithm

Where:

W is an N-dimensional data array.

The algorithm for the weighted error correlation coefficient is as follows:

$$w_i = (X_i - Y_i) * W_i$$

$$x_i = X_i + w_i$$

$$y_i = Y_i - w_i$$

$$r_{we} = \frac{\sum_{i=1}^{N} x_i y_i - \frac{1}{N}\sum_{i=1}^{N} x_i \sum_{i=1}^{N} y_i}{\sqrt{\left(\sum_{i=1}^{N} x_i^2 - \frac{1}{N}\left(\sum_{i=1}^{N} x_i\right)^2\right)\left(\sum_{i=1}^{N} y_i^2 - \frac{1}{N}\left(\sum_{i=1}^{N} y_i\right)^2\right)}}$$

Equation 3

Weighted Error Pearson's Correlation Coefficient Algorithm

Linguistically, the difference between the original algorithm and the weighted-error algorithm is that each point error (the difference between each X and Y data pair) is symmetrically added and subtracted from the original data pair to scale their divergence based on the weighting. Scaling both the X and Y vectors is done for the sake of symmetry and efficiency using integer math; an identical effect could be obtained by scaling one vector by twice as much, or a similar effect garnered by scaling just one vector by the error times the weight.

Thus for a weight array of all 0's, it is obvious that the weighted error correlation corresponds exactly to the original Pearson's correlation coefficient calculation. Nonzero weights magnify the separation between the datum commensurate with that weight's index, thus conferring greater impact to the correlation result. Once weights are utilized, the import of the correlation coefficient is no longer as an indication of similarity, orthogonality, or independence, but strictly as an indicator of data vector trend/sample similarity. It then becomes a scoring method that not only defines data interdependency, but also takes data trending into account, which is synonymous with pattern recognition. Note that the weights are virtually independent—i.e., modifying a weight does not significantly affect the correlation results of the other datum with respect to their weights; i.e. the changes in coefficient results are more additive in nature than when utilizing the typical weighted correlation algorithms. The results aren't purely additive due to the coefficient result modeling the hyperbolic tangent function, and it is thus bounded between two values (−1 and 1), but the linear region still yields much potential for superposition of cumulative error. If the weights are kept at the same value for all the samples, similarly trending vectors still possess high correlation. Another significant aspect of the weights is that as they positively increase for a particular data point, the less deviation from the nominal trend is "tolerated" at that point. Weight values of note are as follows:

Fractional negative weights between 0 and −1 result in data convergence, which has the effect of improving correlation for divergent data.

A weight of −0.5 results in absolute data convergence at that index.

For weight values of −1 or less, weights produce the exact same result as their positive counterpart minus 1; e.g., a weight of −1 produces the same result as a weight of 0. Thus negative weights of −1 or less (e.g., −2, −3, etc.) are trivial.

This method is dissimilar to any existing weighted correlation algorithm, since it was developed to produce superior results when considering ease of implementation, restriction to integer math (due to being ultimately coded for an embedded target), and ability to recognize data trends while still giving separation due to gross errors.

To give some illustrative examples, given a data vector X={0, 100, 200, 300, 400, 500}, a data vector Y={2, 128, 204, 302, 421, 501}, and a weight vector W={5, 5, 5, 5, 5, 5}, the Pearson's correlation coefficient is equal to 0.998 (note the weight vector is meaningless for this calculation), and the weighted-error correlation coefficient is equal to 0.787. Changing the Y vector to Y={100, 200, 300, 400, 500, 600} yields 1 and 1, respectively, and changing the Y vector to Y={−5, 133, 205, 332, 439, 468} yields 0.989 and 0.193, respectively.

Pattern Recognition Algorithm Selection Explication

For the present invention, the pattern recognition tool chosen was weighted-error correlation. This is due to the following reasons:

1) It easily supports feature selection and weight reassignment via utilization of various statistical analysis techniques:
   a) Standard deviation.
   b) Covariance.
   c) Cross-correlation.
   d) Mean, mode, and median, etc.
2) The simplistic validation sensor arrangement of the present invention produces features that demonstrate a Gaussian distribution with a virtually linear dependency amongst the frequency and amplitude responses between the two tank circuits when collecting coin data. In other words, all of the feature data distributions for like coins are very tight, with increasing density as the features approach the centroid/mean value, which favors correlation.
3) Correlation's scoring method can provide desirable rejection in instances SOFM (self-organizing feature map) would fail, due to how the SOFM is usually implemented to only validate a limited number of features. Conversely, WEC (Weighted Error Correlation) can result in desirable acceptance in instances SOFM would reject. This is due to the highly controllable aspect of feature weighting, and how correlation can impart relevance to every feature in exacting detail without overtly affecting tune automation complexity.
4) SOFM is virtually unusable in performing pattern recognition as it applies to validation in a continuous scanning methodology without the utilization of costly runtime data pre-processing and transformation steps.

There are a host of other reasons, but these are by far the most important. SOFM would be a fine validation method using the classical validation methodology, but one of its main detractors is that it tries to make an exact science of an art form, which is not without consequences in a discipline where validating coins and rejecting slugs demands flexibility, simplicity, and adaptability. In any case, the numerical solution is only as good as the information obtained from the sensors.

Continuous Scanning Validation

Continuous scanning places some strict hardware requirements on the operation of the magnetic sensor circuitry. In order to perform continuous scanning, the frequencies being used must be high enough to allow for sufficient over sampling to occur within the validation window. The electronics also need to perform several main tasks in this project given certain bandwidth limitations. The magnetic sensors consist of a pair of inductively coupled wound coils—that possess separate windings—that provide the inductive portion of two separate tank circuits using the same wound inductor. One possesses a natural frequency of 64 kilohertz, and the other resonates at a natural frequency of 200 KHz. Thus all the integrated circuits comprising the electronics must accommodate this bandwidth. The coils are also oriented to be magnetically opposing. This configuration aids in detecting a change in the coin gap, since the flux coupling between the coils will vary with a different air gap between them, as opposed to a single uncoupled coil configuration.

The tank circuit is activated by charging the tank capacitor, and then discharging it through the inductors and resistor. One crucial task is determining an optimal tank circuit charging time, such that unnecessary delay is eliminated and maximal stability is achieved.

As a coin passes between the coils, it influences the flux linkage based on the natural frequency of the tank circuit and the impedance of the coin itself. The higher the resonant frequency of the tank, typically the less deep the imparted flux penetrates the material of the coin. Thus high frequencies impart information as to the magnetic/electrical properties of the coin's surface material, and low frequencies give a more bulk material reading.

To digitize the frequency and amplitude response of the tank circuit, some additional circuitry is required beyond the native capabilities of the microcontroller. In order to obtain the frequency shifts of the 200 and 64 KHz signals and also synchronize sampling of the peaks of the 64 KHz signal, phase detect circuits are used. It is comprised of a comparator with its negative input set to a low pass filter reference—whose input is the coil signal—and its positive input connected to the coil signal, with approximately 50 millivolts of hysteresis across the references to eliminate glitches due to signal noise. As a general rule, sampling the peaks of a sinusoidal waveform directly with a 10-bit analog-to-digital converter (ATD) is possible with reasonable accuracy as long as the ATD sampling capacitor charge time is one-eighth or less the period of the signal. In this application, the ATD clock is 2 MHz, and the 9S12 takes 2 ATD clocks to charge the sampling capacitor, which corresponds to a sampling time of 1 microsecond (1 MHz). This is more than adequate to sample the peaks of the 64 KHz signal.

Software Explication—Continuous Scanning Coin Validation

When the coin breaks the first optic, continuous scanning is initiated at the two frequencies of interest, with each successive scan alternating between the two frequencies. During scanning, 3 features are obtained: the high frequency signal period, and the low frequency signal period and amplitude. Each feature is accumulated in a separate data buffer for each scan. Scanning ends when the second optic becomes blocked and the first optic is unblocked, or when the first optic becomes unblocked and the second optic is blocked. Coins smaller than the optic gap result in the first case, and larger coins result in the latter. This data collection cutoff serves to eliminate unnecessarily redundant data collection due to coin symmetry unless it is desirable to better ascertain the diameter of the coin magnetically. Another beneficial result of this approach is that extra time is garnered for performing coin validation, in the event some coin sorting action is required soon after the coin leaves the second optic.

After the data is collected, it undergoes two conditioning steps. First, the three data buffers are decimated (down sampled) in order to compensate for coin speed variation, which ensures that successive validation data buffers contain samples that correspond to similar coin position acquisition intervals. Secondly, the data is normalized, which compensates for hardware/temperature variation in the validation hardware. This can be performed either via air data compensation—the preferred implementation—or via fixed remapping to an arbitrary range (normalization).

It has been satisfactorily demonstrated that the tank circuit response for a given coin with respect to air readings for a given unit maintains a constant ratio across a wide temperature range (0 to 150° F.), and only fails in temperatures where component thermal ratings are exceeded. It is further postulated that normalization will compensate for unit hardware variation in tank circuit response.

After the data is conditioned, it is compared to numerous sets of nominal feature vectors, with 3 feature vectors per set, some comprising valid coins, and others possibly invalid slugs. Whichever produces the highest passing correlation result while passing its respective minimum score is assumed the pattern match.

Software Explication—Coil Calibration and Coin Tuning

To perform coil calibration, it is first necessary to understand the nature of the coil response, which is an exponentially decaying sinusoid. In order to qualitatively ascertain the full nature of how a coin affects this signal, it is necessary to capture both the change in amplitude envelope and frequency response. This is accomplished via phase detect circuitry, which also aids in synchronizing ATD samples to coincide with the signal peaks. When the phase shift and peak amplitudes are captured, the original signal can be reconstructed in its entirety. For the purpose of coil calibration all that is required is simply to reconstruct the decay envelope of the sinusoid, which is represented by the following function:

$$y = C + \left(A * e^{-\left(\frac{1}{B} * x\right)}\right)$$

Equation 3

2-D Exponential Decay Function where:

x is the sample acquisition interval.

y is the resultant amplitude.

A is the amplitude envelope coefficient, which is indicative of the minimum-to-maximum amplitude delta.

B is the decay rate coefficient (which is inverted for convenience). This is indicative of the time it takes for the signal to approach its limit.

C is the amplitude offset coefficient, which denotes the DC level of the signal.

Calibration is performed by characterizing the captured coil signals at various points of interest (i.e., reference "keys") for the purposes of modeling the entire response range of the coils. These reference points are preferably selected to be near the extreme ends and center of the response range. Characterization is performed using iterative curve-fitting, which finds the A, B, and C parameters that result in the target signal at each reference point. Once the parameters are found, an additional curve fitting process is performed upon the parameters separately to model the curves for each parameter. Thus, the response for each coin lies somewhere on these independent parameter curves.

If a sensor response is linear, then only 2 references are required in order to model the entire range. In this case, the coil response is obviously nonlinear, but as is apparent from the above equation, it is easily modeled using just 3 coefficients and the signal frequency. What further simplifies the process is the fact that the DC offset coefficient (aka "C" parameter) remains constant for the entire response range for a given unit and ambient temperature. Thus once the C parameter is obtained, only the subsequent A, B and frequency reference parameters vary.

After the response range is characterized, the coil response for a given coin is captured and characterized. Then the ratio of the coin parameters to the reference points is used to interpolate the coil response for any characterized unit, assuming the ratio can be extrapolated from historical tabulated characterization results.

GLOSSARY

ANN—artificial neural network. Neural networks are programs that perform pattern recognition after a training process that utilizes various statistical numerical analysis techniques.

BMP—back-propagation multilayer perception, a supervised-learning ANN that must be provided the output in order to map the inputs. It is typified by randomly adjusting the "neuron" weights, and then iteratively checking for reduction in the squared error between the calculated and actual outputs. Increasing orders of neurons are utilized in order to perform more and more complex classification tasks.

cluster—a grouping of features that have been "perceived" via statistical or neural analysis to possess relatively high dependency for use in pattern recognition/rejection. Feature clusters can also be identified using covariance and/or cross-correlation between desirable and undesirable feature databases.

feature—in the field of statistical and neural pattern recognition, a feature is data that represents a one-dimensional object (typically the numerical output of a sensor) used as an input for pattern recognition, often in conjunction with other features. The same feature may also be accumulated to provide multidimensionality for the purpose of pattern recognition, usually over time.

key—for the purposes of calibration, an object used to provide a reference characteristic. In coin acceptor magnetic sensor calibration, this is often either a coin that produces a desired response mounted in an appropriate fixture, or a metallic strip that is inherently a fixture, or even the "natural" response when at rest.

neuron—in many neural network methodologies, the number of neurons corresponds to the number of input and output weights.

SOFM—self-organizing feature map, an unsupervised learning ANN that uses data clustering algorithms to map high-dimensioned data vectors to a lower dimensional feature space. SOFMs are completely dissimilar to other neural network implementations such as BMPs, and do not utilize "neurons".

tune—a collection of nominal coin feature values and validation parameters used as the basis for coin identification, obtained through rigorous data collection and analysis.

weight—a value that is used to define feature dependence or relevance in pattern recognition.

validation window—the absolute maximum time that can elapse during data collection and classification.

WEC—Weighted Error Correlation.

The forgoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by the details of the embodiments presented in this description. The above specification, examples, and data provide a complete description of the manufacture and use of the invention. Many embodiments of the invention can be made without departing from the spirit and scope of the invention.

What is claimed is:

1. A method of examining a coin for determining the validity of its denomination, comprising: moving a coin through a passageway; sensing said moving coin in said passageway with one or more sensors to interact with said moving coin and provide at least two values indicative of the said coin; calculating two or more coin features by using said at least two values; determining that said coin features values lie between predetermined minimum and maximum stored values; applying a predetermined coefficient of weighted-error to each of said coin features; calculating a weighted-error correlation coefficient using two or more of the said coin feature values; and determining validity when the said calculated weighted-error correlation coefficient lies above the predetermined minimum stored values.

2. A method of examining a coin for determining the validity of its denomination, comprising: providing an inclined coin track for rolling said coin on its edge; sensing said moving coin in said passageway with one or more sensors to interact with said moving coin and providing at least two values indicative of the said coin; calculating two or more coin features by using said at least two values; determining that said coin features values lie between predetermined minimum and maximum stored values; applying a predetermined coefficient of weighted-error to each of said coin features; calculating a weighted-error correlation coefficient using two or more of the said coin feature values; and determining validity when the said calculated weighted-error correlation coefficient lies above the predetermined minimum stored values.

3. A method of examining a coin for determining the validity of its denomination, comprising;

moving a coin through a passageway; sensing said moving coin in said passageway with one or more sensors to interact with said moving coin and provide at least two values indicative of the said coin;

calculating two or more coin features by using said at least two values;

determining that said coin features values lie between predetermined minimum and maximum stored values to determine the said coin denomination;

applying a predetermined coefficient of weighted-error to each of said coin features; calculating a weighted-error correlation coefficient using two or more of the said coin feature values; and determining validity when the said calculated weighted-error correlation coefficient lies above the predetermined minimum stored values for said denomination.

4. The method of claim 1, 2 or 3 wherein one of the said coin features is at least one or more tau values indicative of the said coin.

5. The method of claim 1, 2 or 3 wherein one of the said coin features is at least one or more phase values indicative of the said coin.

6. The method of claim 1, 2 or 3 further comprising; directing said coin to a coin store, cash box or coin return port.

7. The method of claim 1, 2, or 3 wherein one of the coin features is obtained with the coin in at least two or more different positions.

* * * * *